United States Patent [19]

Takimoto

[11] Patent Number: 4,932,350

[45] Date of Patent: Jun. 12, 1990

[54] SUBMERSIBLE

[76] Inventor: Shohzoh Takimoto, 1-48, Minato honmachi, Handa-shi, Aichi-ken, Japan

[21] Appl. No.: 250,255

[22] Filed: Sep. 27, 1988

[30] Foreign Application Priority Data

Jun. 9, 1988 [JP] Japan ..... 63-144391

[51] Int. Cl.[5] ..... B63G 8/14

[52] U.S. Cl. ..... 114/330; 114/337; 114/339

[58] Field of Search ..... 114/312, 313, 314, 322, 114/326, 327, 330, 331, 332, 337, 338, 339, 340, 342, 354, 56; 440/17, 18

[56] References Cited

U.S. PATENT DOCUMENTS

| | | | |
|---|---|---|---|
| 1,175,609 | 3/1916 | Cottrell | 114/340 |
| 3,678,872 | 7/1972 | Miglaccio et al. | 114/332 |
| 4,577,583 | 3/1986 | Green, II | 114/332 |

FOREIGN PATENT DOCUMENTS

| | | | |
|---|---|---|---|
| 20269 | of 1898 | United Kingdom | 440/17 |
| 5513 | of 1904 | United Kingdom | 440/17 |

*Primary Examiner*—Joseph F. Peters, Jr.
*Assistant Examiner*—Edwin L. Swinehart
*Attorney, Agent, or Firm*—Foley & Lardner, Schwartz, Jeffery, Schwaab, Mack, Blumenthal & Evans

[57] ABSTRACT

A submersible is provided for exploration of the sea or other purposes. The submersible includes a hull made up of three outer shell sections. A first outer shell section has one end opening through which a second outer shell section is inserted into the first outer shell section for horizontal movement. A third outer shell section is inserted into the second outer shell section through one end opening thereof for horizontal movement. Packings are applied between the first and second outer shell sections and between the second and third outer shell sections, respectively. One or both of the second and third outer shell sections are moved outwardly and inwardly by actuators so that the net displacement of the submersible is increased and decreased. By moving the third outer shell section, the center of gravity of the submersible may be transferred so as to be positioned beneath the center of buoyancy. Each propeller for underwater cruise includes a cylinder into which high pressurized fluid is fed, a piston reciprocally moved by the force of high pressurized fluid, and drivers for propelling water in response to reciprocal movement of the piston.

2 Claims, 4 Drawing Sheets

SUBMERSIBLE

BACKGROUND OF THE INVENTION

1. Field of the Invention

The present invention relates to submersibles used for exploration of the sea or other purposes.

2. Description of the Prior Art

In the submersibles used for oceanographic investigation or other purposes, a fluid such as sea water is fed and discharged into and from buoyancy tanks provided in the hull to increase and decrease the weight of the hull when the submersible cruises underwater or surfaces, thereby increasing and decreasing the specific gravity of the hull. In the case of attitude control of the hull while the submersible is under water, a quantity of mercury contained in trimming tanks provided at the front and rear portions of the hull is increased and decreased so that the center of gravity of the hull is transferred beneath the center of buoyancy. When the submersible cruises underwater, a screw propeller is driven through a storage battery to obtain propulsive force.

It has recently been desired to commercially produce submersibles suitable for the maintenance of submarine oil fields, oceanographic investigations in relatively shallow sea areas, fishing ground search, the works at so-called sea stock farms, submarine transportation, and other purposes. However, the conventional submersibles have the following disadvantages which make it difficult to meet the above-mentioned needs. Firstly, the submersible largely depends upon the buoyancy tanks in the movement thereof under water. The buoyancy &tanks are required to be rendered larged-sized so that the submersible is designed to be large-scaled, to be capable of being loaded with various equipments, or to transport a large amount of cargo. Accordingly, the submersible hull is caused to be more and more large-scaled. As the hull is large-scaled, the propeller is also rendered large-scaled, resulting in increasing of the weight of the storage battery. Additionally, the submersible necessitates another buoyancy tank in order that the heavy equipments or collections may be transported from one place to another under water. As a result, the hull of the submersible is required to be rendered large scaled. Furthermore, a large quantity of mercury for the adjustment of the center of gravity of the hull needs to be contained in the front and rear trimming tanks so that the submersible can be loaded with articles or goods under water. In the case of the attitude control by means of mercury containing trimming tanks, the front and rear trimming tanks are communicated to each other by a pipe, and the mercury is transferred between the front and rear tanks through the pipe. As a result, rotation moment is induced to the hull. When the hull is controlled to be maintained at the horizontal position, the transportation of mercury is caused to stop, whereby the hull is maintained at the horizontal position, and consequently, the center of gravity of the hull is positioned beneath the center of buoyancy. The quantity of mercury is increased where the cargo loaded is located, for example, on an edge portion of the hull for the sake of convenience in loading and unloading the cargo. Accordingly. the weight of the hull is necessarily increased, resulting in increase of the frictional resistance of the hull and therefore, reduction of the underwater cruising capacity.

Secondary, the conventional submersible employs the construction that the screw propeller for the underwater cruise is driven through a storage battery. The storage battery usually has a large weight, and a large-sized storage battery causes the buoyancy of the hull to be large. Consequently, the hull is further rendered large-scaled.

SUMMARY OF THE INVENTION

Therefore, a primary object of the present invention is to provide a submersible which is capable of transporting various kinds of cargo such as equipments and various materials and of decreasing the cubic measurement of the hull in the underwater cruising, though the buoyancy tanks and mercury containing trimming tanks are rendered small-scaled.

A second object of the present invention is to provide a submersible which is provided with underwater cruising propellers driven by means of a high pressurized fluid instead of the storage battery usually having a large weight.

In view of the above mentioned objects and others, the submersible in accordance with the present invention comprises a hull comprising first, second, and third outer shell sections. The first outer shell section has an opening end, and the second outer shell section has an opening end. The second outer shell section is movably inserted into the first outer shell section through the opening end thereof. The third outer shell section is also movably inserted into the second outer shell section through the opening end thereof. Water sealing means are provided between the first and second outer shell sections and between the second and third outer shell sections, respectively. A propeller for the underwater cruising is mounted on the hull. The submersible further comprises propeller drive means for driving the propeller and outer shell section drive means for moving the second and third outer shell sections lengthwisely relative to the hull. One or both of the second and third outer shell sections are moved by the outer shell section drive means so that the whole displacement of the hull is increased and decreased. The third outer shell sec-&ion is moved by the outer shell section drive means to be stretched and contracted so that the center of gravity of the submersible is transferred so as to be positioned beneath the center of buoyancy of the submersible.

To attain a desirable effect, the propeller drive means comprises a cylinder into which a high pressurized fluid is fed, and a piston reciprocally moved by the high pressurized fluid. The propeller is adapted to push water away in response to the movement of the piston.

According to the submersible constructed above, one or both of the second and third outer shell sections are moved by the outer shell section drive means so that the whole length of the hull is adjusted, thereby increasing and decreasing the whole displacement of the submersible. In the same manner, the third outer shell section is moved by the outer shell section drive means so that the center of gravity is transferred to be located beneath the center of buoyancy. The above-described movement of the second outer shell section provides for a large degree of increase and decrease in the buoyancy. Since the second outer shell section is disposed in the central portion of the hull, the center of gravity is not transferred in a large degree by the movement of the second outer shell section. However, since the third outer shell section forms the rear end portion of the hull, the center of gravity may be transferred sufficiently by the movement of the third outer shell section.

In the propeller drive means comprising the cylinder and piston, a high pressurized fluid is supplied into the cylinder so that the fluid pressure causes the propeller to push the water away, thereby obtaining propulsive forces without employing the storage battery as a main power source.

Other and further objects of this invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

Figure 1:
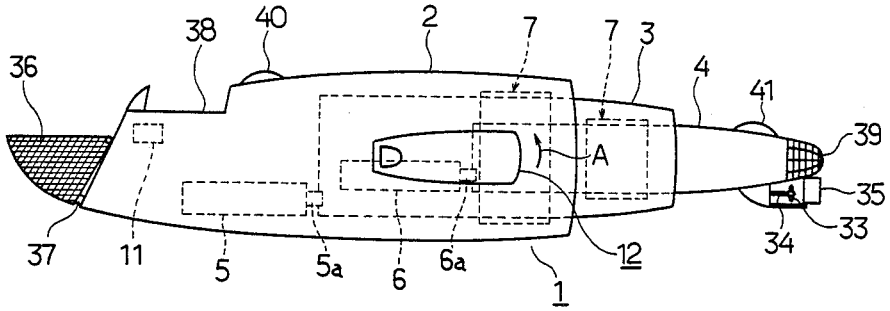
FIG. 1 is a side view of the submersible of an embodiment in accordance with the present invention.
Figure 2:
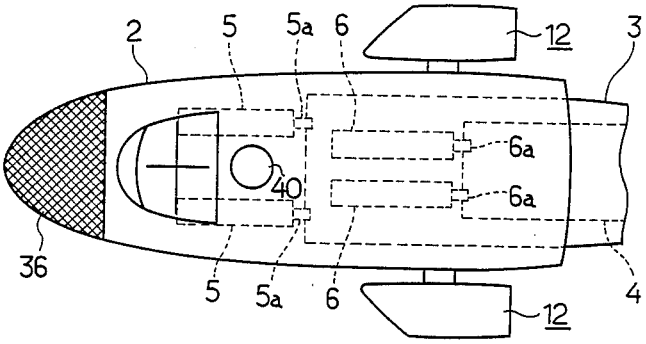
FIG. 2 is a partial top view of the submersible.
Figure 3:
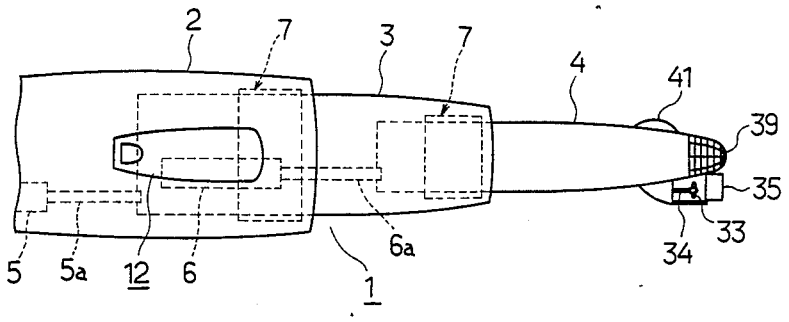
FIG. 3 is a partial side view showing the hull of the submersible extended at the most.
Figure 4:
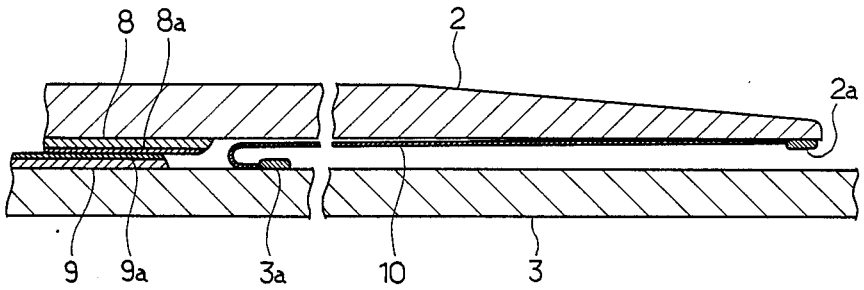
FIG. 4 is a partially cross sectional view showing packings as water sealing means in the condition that the hull is contracted at the most.

An embodiment of the present invention will now be described with reference to the drawings. Referring first to FIGS. 1–3, reference numeral I indicates a submersible hull comprising three outer shell sections 2, 3, and 4. A first outer shell section 2 have an opening formed at the rear end thereof. A second outer shell section B is inserted into the first outer shell section 2 through the rear opening thereof so as to be movable horizontally or lengthwisely. The second outer shell section 3 has openings formed at the front and rear ends thereof, respectively. A third outer shell section 4 is inserted into the second outer shell section 3 through the rear opening thereof so as to be movable horizontally or lengthwisely. The third outer shell section 4 has an opening formed at the front end thereof. Two hydraulic cylinders 5 each serving as an outer shell section drive means are mounted in the first outer shell section 2. Two rods 5*a* of the respective hydraulic cylinders 5 are coupled to the second outer shell section 3 at a portion of the front opening end thereof. Similarly, two hydraulic cylinders 6 are mounted in the second outer shell section 3 and rods 6*a* of the respective hydraulic cylinders 6 are coupled to the third outer shell section 4 at a portion of the front opening end thereof. A packing 7 as water sealing means is provided between the first and second outer shell sections 2 and 3 for watertightly sealing the space therebetween. Construction of the packing 7 will be described. Referring to FIG. 4, reference numerals 8 and 9 indicate outer and inner cylinders each formed of banded cylindrical elastic material. The outer and inner cylinders 8 and 9 are secured to the inner surface of the first outer shell section 2 and the outer surface of the second outer shell section 3, respectively. Lubricating sheet members 8*a* and 9*a* are applied to the faces of the outer and inner cylinders 8 and 9 in contact with each other, respectively. Reference numeral 10 indicates a water sealing sheet member formed of a banded cylindrical flexible material. One end of the water sealing sheet member 10 is fixed to the inner peripheral edge 2*a* of the opening end of the first outer shell section 2 and the other end to the outer peripheral 3*a* of the second outer shell section 3 at the front end thereof. The water sealing sheet member 10 is folded at the intermediate portion thereof. When the second outer shell section 3 is horizontally moved, the lubricating sheet members 8*a* and 9*a* are slidably moved and the folded intermediate portion of the water sealing member 10 is moved so that interior of each of the outer shell sections 2 and 3 are maintained at the watertight condition. Another packing 7 is provided between the outer shell sections 3 and 4 in the same manner as described above. The outer shell sections 2, 3, and 4 of the hull 1 are thus moved so that the whole length thereof is increased and decreased, and maintained at the watertight condition. The movement of the outer shell sections 2, 3, and 4 is controlled by a microcomputer 11 as a control means provided in the front inner portion of the first outer shell section 2 and also manually controlled. When an instruction is inputted to the microcomputer 11 by an operator, either one or both of the hydraulic cylinders 5 and 6 are driven in accordance with a predetermined program to thereby control the movement of either one or both of the second and third outer shell sections 3 and 4, whereby the microcomputer 11 executes the surfacing and submerging speed control and the balancing control.

Figure 5:
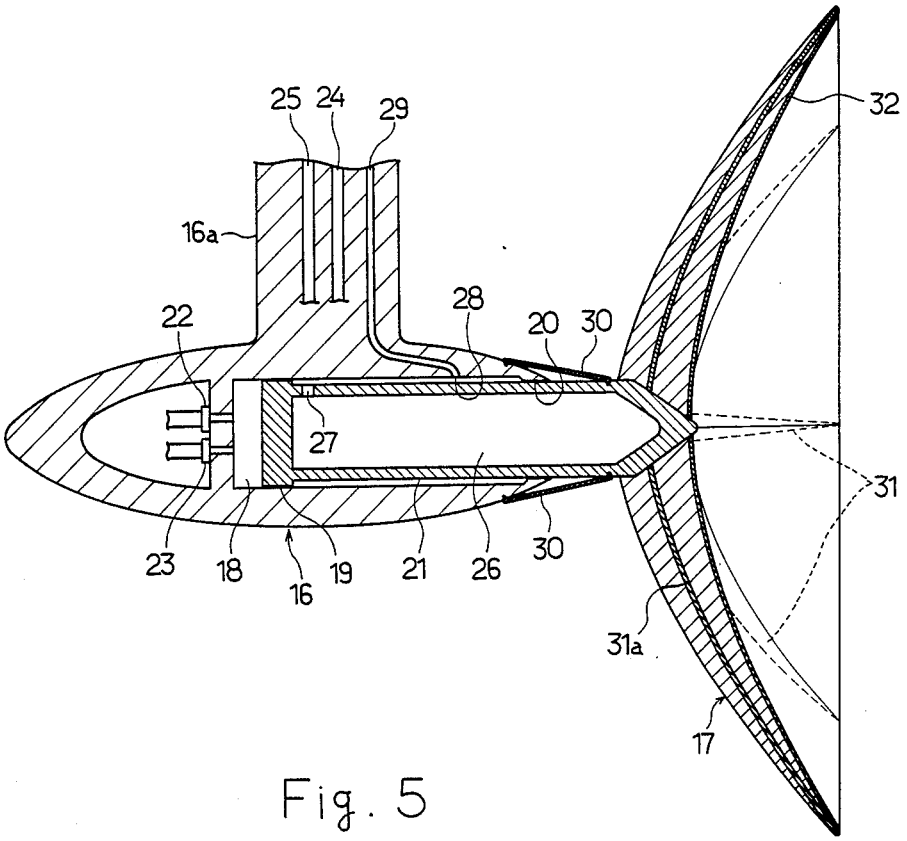
FIG. 5 is a cross sectional view of the propeller and the propeller drive means.
Figure 6:
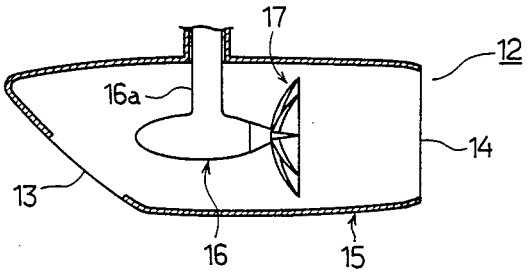
FIG. 6 is a cross sectional view of the propeller drive mechanism including the propeller and the propeller drive means shown in FIG. 5.
Figure 7:
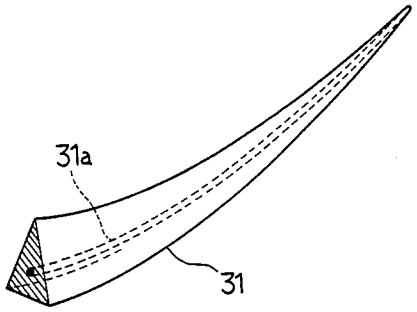
FIG. 7 is a partial perspective view of the frame member constituting the propeller.
Figure 8:
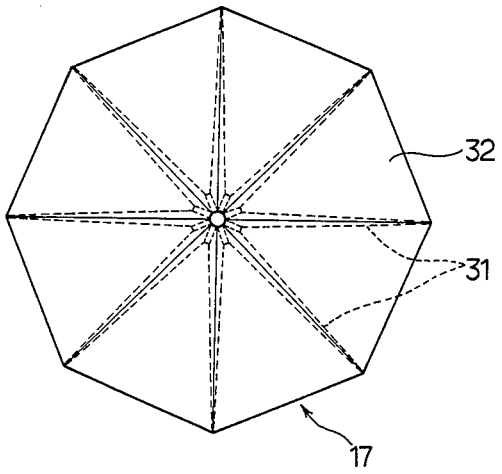
FIG. 8 is a front view of the propeller.

Two propeller drive mechanisms 12 are mounted on the both side walls of the second outer shell section 3, respectively. The propeller drive mechanisms 12 are independently rotatably moved in the direction of arrow A and in the direction opposite to arrow A, as shown in FIG. 1. Each propeller drive mechanism 12 comprises an enclosure 15 having a water intake 13 at the front end and a water outlet 14 at the rear end, a propeller drive means 16 provided in the enclosure 15, and an underwater cruising propeller 17 driven by the propeller drive means 16, as shown in FIG. 6. Referring to FIG. 5 showing the inside of the propeller drive means 16, reference numeral 18 indicates a cylinder chamber. A piston 19 and a piston rod 21 integrally fixed thereto are provided in the cylinder chamber 18, and the distal end of the piston rod 21 outwardly extends through an opening 20 formed in the wall of the cylinder chamber 18. Air intake and outlet valves 22 and 23 are mounted on one end of the cylinder chamber 18 so as to be connected to air intake and outlet pipes 24 and 25 extending through a support portion 16*a* into the hull 1, respectively. Within the hull 1 are provided an internal combustion engine, compressor driven by the internal combustion engine for supplying with compressed air (as high pressurized fluid), and compressed air reservoir, neither shown. The compressed air is fed from the reservoir to the cylinder chamber 18 through the air intake pipe 24 and valve 22, thereby extruding the piston 19. When the piston 19 is to be withdrawn, the air is exhausted from the cylinder chamber 18 into the hull 1 through the outlet valve 23 and pipe 25. A gas reservoir 26 formed in the piston rod 21 communicates to a pressure applying port 28 through a junction port 27 so as to be connected to a pressure applying pipe 29 extending through the support portion 16*a* of the propeller drive means 16, thereby applying pressure to the piston rod side and gas reservoir 26 in the cylinder chamber 18. As a result, even when pressure is reduced at the piston rod side in the cylinder chamber 18 in the case of withdrawal of the piston rod 21, the watertightness is maintained between the piston rod 21 and the opening 20. Elastic bodies 30 for return movement are suspended between the propeller drive means 16 and the distal end of the piston rod 21 so as to urge the rod in the direction of its withdrawal movement. Each propeller 17 comprises frames 31 (see FIG. 7) having respective reinforcements 31*a* therein and a sheet member 32 formed of a flexible material. Frame members 31 each have a curved triangular pyramid configuration and are radially arranged. The sheet member 32 is attached to the inside of the frame members 31. Thus, the propeller 17 has a generally umbrella-like configuration. The propeller 17 is secured to the outwardly extending end of the piston rod 21. With extrusion of the piston rod 21, the propeller 17 pushes the water backwardly, and when the piston rod 21 is withdrawn, the frame members 31 are caused to be curved so as to be contracted together with the sheet member 32 with the water resistance reduced.

Referring to FIG. 1, reference numeral 33 indicates a screw propeller for sailing on the sea. The screw propeller 33 is provided at the lower rear portion of the third outer shell section 4 and fixed to a drive shaft 34 inserted into the hull 1. The drive shaft 34 is connected to a rotational shaft of the internal combustion engine for feeding the compressed air. A rudder 35 is mounted on the third outer shell section 4 behind the screw propeller 33.

A loading section 36 provided on the bow of the hull 1 is formed of transparent plastics. The loading section 36 has an upper opening and is configured into a container. The loading section 36 has a large number of water passing appertures in the bottom wall and the circumferential wall thereof. An underwater weight detector 37 is provided between the hull 1 and the loading section 36 for obtaining the underwater weight of the articles loaded on the loading section 36 by subtracting the value of the buoyancy from the value of the weight of the articles loaded on the loading section 36. Reference numeral 38 indicates an operator's seat provided in &he front upper portion of the first outer shell section 2. A large number of waterproofed control equipments (not shown) are also provided in the portion of the outer shell section 2 where the operator's seat 30 is provided. These equipments include an accumulator serving as a hydraulic equipment for moving the second and third outer shell sections 3 and 4, a hydraulic transmission system, a hydraulic motor, a variable capacity hydraulic pump, hydraulic fluid and pressure control valves, a hydraulic intensifier, oil tank, small-sized highly efficient electric cells, compressed air bombs for main hydraulic power source, and control equipments for detecting the conditions of the other attachments to control the movement of the outer shell sections 3 and 4. The control equipments further include a high pressurized fluid accumulator for activating the propeller drive means 12, an intensifier, fluid valve operation speed control means, fluid and fluid pressure control means, operation equipments for operating the other propelling devices. The submersible is further provided with operation equipments for operating hydraulic unit and hydraulic system for driving the propeller drive means 12 for reciprocating motion in the case that the submersible is steered in the water, and the microcomputer 11 which controls the submersible in response to a signal in the case where variance of the values of the depth of the sea measured by a water pressure gauge (not shown) exposes the operator to danger. The submersible is further provided with a compass for determining the underwater attitude of the submersible, horizontal attitude control means employing small-sized trimming tanks, inner pressure control means, underwater telephone means, depth indicator, speed meter, searchlight operating switch, other equipments for steering the submersible, small-sized high efficiency electric cells, and the like. The operator sits on the operator's seat 3B with a diving suit on to drive the submersible. Reference numeral 39 indicates a cabin provided at the rear portion of the third outer shell section 4. Various measurement equipments (not shown) are provided in the cabin 39. The first and third outer shell sections 2 and 4 have hatches 40 and 41 provided on the upper faces thereof, respectively. Each of the hatches 40 and 41 serves as an entrance and exit for the interior of the hull 1. Auxiliary small-sized mercury containing trimming tanks (not shown), high pressurized bombs as an auxiliary power source (not shown) are installed in the hull 1.

The operation of the submersible of the embodiment will now be described. First, the screw propeller 33 is rotatably driven by an internal combustion engine (not shown) so that the submersible is driven on the sea to a designated water area where the submergence is executed. In the case of sailing on the sea, the hull 1 is controlled so that the second and third outer shell sections 3 and 4 are outwardly extended at the most, as shown in FIG. 3, thereby maximizing the displacement of the submersible to obtain sufficient buoyancy. The compressed air supplied by the internal combustion engine is beforehand reserved in the reservoir while the submersible is on the sea.

When a submergence instruction is inputted to the microcomputer 11, it operates to control the hydraulic cylinders 5 and 6 in accordance with a predetermined program in which the submerging speed of the submersible is determined so that sudden change of the water pressure and the exposure of the operator to danger are prevented, thereby horizontally moving the second and third outer shell sections 3 and 4 to reduce the buoyancy. The hull is then contracted so that the center of gravity is transferred to be positioned beneath the center of buoyancy. and then the submersible starts submerging.

Subsequently, the propeller drive means 16 are driven. The air intake valve 22 of cylinder chamber 18 of each propeller drive means 16 is opened and the air outlet valve 23 thereof is closed so that the compressed air is supplied from the compressed air reservoir to the cylinder chamber 18 through the air feed pipe 24, whereby the piston 19 and piston rod 21 are extruded in the right direction against the force of the return elastic body 30, as seen in FIG. 6. Each propeller 17 then pushes water backwardly to thereby obtain the propulsive force by means of reaction. Then, when the air intake valve 22 is closed with the air outlet valve 23 opened, the piston 19 is urged in the left direction by the return elastic body 30 as seen in FIG. 5, whereby the compressed air in the cylinder chamber 18 is exhausted to the hull 1 through the air outlet pipe 25. The propeller 17 is withdrawn in the left direction with the movement of the piston 19 and piston rod 21, as seen in FIG. 5. The frame members 31 of the propeller 17 are caused to be curved so that the water resistance is reduced to the most by the frame members 31 and the sheet member 32. The opening and closing operations of the air intake and outlet valves 22 and 23 are reiterated, thereby driving the submersible under water. The underwater driving speed of the submersible may be varied by increasing and decreasing the pressure of air supplied to the cylinder chamber 18 or by increasing and decreasing the speed of the closing and opening cycle of each of the air intake and outlet valves 22 and 23. When the propeller drive mechanisms 12 are rotatably moved so as to occupy an approximately vertical position during the underwater cruising, each of the enclosures 15 severely suffers water resistance against the direction in which the submersible goes ahead, thereby braking the hull 1. When the propeller drive mechanisms 12 are rotatably moved so that each of the heads thereof occupies the lower and upper most positions, the propulsive force may be obtained for submerging or surfacing. Furthermore, when one of the propeller drive mechanisms 12 is rotatably moved so that the head thereof is directed to the bow side of the submersible with the head of the other propeller drive mechanism 12 directed to the stern side thereof, the hull 1 is turned to another direction.

When the submersible reaches the bottom of the sea, the articles are loaded on the loading section 36 of the hull 1, for example. The value of underwater weight of the articles loaded may be obtained by the underwater weight detector 37. In the manual operation in the case of the surfacing, the hydraulic cylinder 5 is operated by the operator so as to be gradually extended. When the hull 1 starts surfacing, the hydraulic cylinder 6 is gradually extended. The attitude of the submersible is adjusted by the hydraulic cylinders 5 and 6 so that the hull 1 takes a horizontal attitude in the condition that the hull 1 is floating a little from the bottom of the sea. Should the hull 1 not be maintained at the hotizontal attitude by the operation of the hydraulic cylinders 5 and 6, the small-sized trimming tanks (not shown) may be used. Upon completion of the attitude adjustment of the hull 1, an instruction is inputted to the microcomputer which is programmed so that the submersible surfaces at the speed at which the human body is not exposed to danger. When the submersible surfaces on the sea, the displacement of the submersible is controlled so as to take the maximum. Depending upon the condition, the high pressurized bombs as auxiliary power source may be used to obtain the drive force.

According to the above-described embodiment, the hull 1 of the submersible comprises three outer shell sections 2, 3, and 4. The second and third outer shell sections 3 and 4 are moved by the hydraulic cylinders 5 and 6 so that the whole displacement of the submersible is increased and decreased. Furthermore, the movement of the third outer shell section 4 causes the center of gravity to transfer beneath the center of buoyancy. Accordingly, since the capacity of the hull 1 may be decreased in the sea, the frictional resistance of the water relative to the hull 1 may be decreased, thereby reducing loads against the propeller drive mechanisms 12 for the underwater cruising. Furthermore, since the hull 1 may be extended to obtain large buoyancy with the increase of articles loaded, large-sized buoyancy tanks or large-sized trimming tanks are not needed.

The compressed air as high pressurized fluid reciprocally moves the piston 19 in the cylinder chamber 18 so that the propeller 17 pushes the water backwardly, thereby obtaining the propulsive force of the hull 1. Accordingly, the storage batteries conventionally employed as the main power source are not needed in the submersible of the present invention. Consequently, the number of buoyancy tanks is decreased and the hull 1 ia rendered small-scaled, thereby reducing the frictional resistance of the water relative to the hull 1.

Since the second and third outer shell sections 3 and 4 are moved so that the length of the hull 1 is reduced, the hull 1 may be rendered small-sized. As a result, the space for housing the submersible may be saved and the transportation of the submersible is convenient.

Since the weight of the hull 1 is reduced, the submersible of the present invention may be applied to an amphibian, a ship which has hydrofoils for high speed cruising on the water and is capable of submerging, and the like.

Although the first outer shell section side is taken as the front of the submersible in the foregoing embodiment, the propeller drive mechanisms 12 may be mounted so that each propeller 17 pushes the water in the direction opposite to that mentioned in the foregoing embodiment, whereby the third outer shell section side is taken as the front of the submersible.

In the foregoing embodiment, the length of the hull 1 is determined to take the value of 5–10 meters in the condition that the second and third outer shell sections 3 and 4 are contracted. However, the length of the hull 1 may take the value larger or smaller than that mentioned above.

The foregoing disclosure and drawings are merely illustrative of the principles of the present invention and are not to be interpreted in a limiting sense. The only limitation is to be determined from the scope of the appended claims.

What is claimed is:

1. A submersible comprising:

(a) a hull comprising a first outer shell section having an open end, a second outer shell section having first and second open ends and movably inserted, at the first open end, into the firs touter shell section through the open end thereof, and a third outer shell section movably inserted into the second outer shell section through the second open end thereof;

(b) water sealing means provided between the first and second outer shell sections and between the second and third outer shell sections, respectively;

(c) propellers provided on said hull for underwater cruising;

(d) propeller drive means for driving said propellers;

(e) buoyancy control means for controlling the buoyancy of the hull by moving the second outer shell section relative to the first outer shell section so that the gross displacement tonnage of the hull is controlled; and (f) drive means for moving the third outer shell section relative to the first outer shell section so that the attitude of the hull is controlled.

2. A submersible as claimed in claim 1, wherein said propeller drive means comprises a cylinder into which a high pressurized fluid is fed and a piston reciprocally moved by the high pressurized fluid in the cylinder and wherein each said propeller is adapted to reciprocally move to push the water away in response to the movement of the piston.

* * * * *